US005152462A

United States Patent [19]

Evans

[11] Patent Number: 5,152,462

[45] Date of Patent: Oct. 6, 1992

[54] SPRAY SYSTEM

[75] Inventor: Edward Evans, Jacksonville, Fla.

[73] Assignee: Roussel Uclaf, Paris, France

[21] Appl. No.: 566,164

[22] Filed: Aug. 10, 1990

[51] Int. Cl.[5] ..... B05B 7/08

[52] U.S. Cl. ..... 239/304; 239/433; 239/532; 239/549

[58] Field of Search ..... 239/304, 307, 311, 312, 239/443, 444, 390, 391, 549, 445, 446, 416.5, 423, 433, 532

[56] References Cited

U.S. PATENT DOCUMENTS

| | | | |
|---|---|---|---|
| 2,062,097 | 11/1936 | Lingard | 239/525 |
| 2,868,584 | 1/1959 | Faust | 239/444 |
| 3,144,967 | 8/1964 | McClain | 239/445 |
| 3,375,823 | 4/1968 | Pamplin et al. | 239/549 |
| 3,799,451 | 3/1974 | Kollmai | 239/312 |
| 4,621,770 | 11/1986 | Sayen | 239/444 |
| 5,082,185 | 1/1992 | Evans | 239/525 |

FOREIGN PATENT DOCUMENTS

| | | | |
|---|---|---|---|
| 66438 | 5/1946 | Denmark | 239/5337 |

*Primary Examiner*—Andres Kashnikow

*Assistant Examiner*—Christopher G. Trainor

*Attorney, Agent, or Firm*—Bierman and Muserlian

[57] ABSTRACT

An apparatus for dispensing at least two liquid compositions, one as a wet spray and one as an aerosol spray comprising at least two liquid supply reservoirs, an air supply for pressurizing the reservoirs, and individual capilliary tubes connecting the reservoirs and a pressurized air source to a dispensing wand. The wand comprises a solid handle with ducts therein connected at one end to one of the capilliary tubes, each duct provided with a suitable valve for controlling fluid flow therethrough. A tube is attached at the opposite end of the handle with capilliary tubes therein attached to the liquid ducts passing therethrough to a nozzle head attached to the opposite end of the tube. The nozzle head is provided with a nozzle to dispense a liquid in the form of a wet spray and a nozzle to dispense a liquid as an aerosol spray with pressurized air passing therethrough and mixing with the liquid to provide the aerosol spray. The pressurized air passes through the handle directly into the tube for mixing with the liquid in the nozzle to form the aerosol spray to apply insecticides both in liquid spray form and as an aerosol spray.

5 Claims, 3 Drawing Sheets

SPRAY SYSTEM

STATE OF THE ART

A compressed air sprayer consisting of a liquid reservoir under hand pumped pressure connected to a hand held wand with a metal tube connected to the handle of the wand and a hand actuated valve mechanism in the vicinity of the handle is known. This dispensing nozzle was at the end of the ⅜" on the outside diameter tube approximately 12 inches from the handle. When the spraying was stopped, the metal tube was filled with liquid and air under pressure and since the nozzle orifice was smaller than the connecting tube, excess fluid in the tube under pressure would leak from the tip of the wand after the shut off valve near the handle had been closed. This created environmental problems and loss of valuable product.

One solution to the problem was to relocate the shut off valve mechanism adjacent and immediately behind the nozzle. Since the application wand is usually bent at or near the nozzle end, a cable threaded at both ends was used to connect the hand actuated valve to the shut off mechanism via the inside of the connecting tube.

Because the operation of this system has to rely upon a hand pump to create the desired pressure of about 30 psi to start application of the liquid, problems occur because each subsequent actuation of the valve mechanism achieves less pressure and the pattern and flow rate vary causing stains, oversprays or undersprays. Consistency of the spray depends solely upon the operator's energy level to maintain a constant pressure in the sprayer to avoid poor application. Moreover, the operator had to have the sprayer at his side at all times when flushing out insects from deep harborages so that he may knock down and kill any or all insects as they emerge. If not, these insects will scurry away to reinfest other areas of the structure and this means that the operator is constantly picking up and putting down one tool or the other throughout the application. Invariably, some insects escape which costs extra time and motion and the operator has less profitability.

OBJECTS OF THE INVENTION

It is an object of the invention to provide a spray system capable of dispensing fluids in both liquid spray and aerosol spray form with a uniform pressure.

It is a further object of the invention to provide a sprayer system which frees the operator from manually maintaining the pressure and allows the operator to move about away from the pressure system.

These and other objects and advantages of the invention will become obvious from the following detailed description.

THE INVENTION

The novel spray system of the invention for dispensing at least two liquid compositions, one as a wet spray and one as an aerosol spray comprises at least two liquid supply reservoirs, means for pressurizing said reservoirs, individual capilliary tubes connecting said reservoirs and a pressurized air source to a dispensing wand, said wand comprising a solid handle with ducts therein and means for connection at one end to one of the capilliary tubes, each duct provided with a suitable means for controlling fluid flow therethrough, a tube attached at the opposite end of the handle with capilliary tubes therein attached to the liquid ducts passing therethrough to a nozzle head attached to the opposite end of the tube provided with a nozzle means to dispense a liquid in the form of a wet spray and a nozzle means to dispense a liquid as an aerosol spray with pressurized air passing therethrough and mixing with the liquid to provide the aerosol spray and the pressurized air passes through the handle directly into the tube for mixing with the liquid in the aerosol spray nozzle.

Prior to this invention, aerosol applications were made by canned pre-packaged aerosols or mechanical aerosol generators. Pre-packaged aerosols allowed injection of pesticides into cracks and crevices, wall voids, etc. with the use of a plastic straw tip which allowed for precise placement. Mechanical aerosol generators are relied on for space treatment of rooms, warehouses, etc. for flying insects and surface crawling type insects, on a shotgun type principle but were not effective on deep harborage infestations since they were not capable of penetrating dead end voids of deep harborages, or entering small cracks and crevices.

The present system allows the operator to have at his or her disposal on a single wand both the wet spray from a compressed air sprayer and the aerosol flushing action of the pre-packaged aerosol, both fitted for the desired pinpoint accuracy of the application demanded by today's professionals, thus minimizing overspray, underspray, off-target spray, runs, and stains while reducing environmental contamination.

The system of the invention as a whole frees the operator from the need for manual pumping of the sprayer by using regulated compressed air to maintain a constant desired pressure on a residual pesticide tank with a means to agitate liquids, wettable powder, etc., which remain on the machine during operation and also preferably, incorporates a 50 foot, color coded light weight, 400 psi. burst pressure triple hose configured in a triangle shape and sleeved on the outside with a clear polyurethane jacket to reduce abrasion. The said hose allows the operator the ease to move about in a 50 foot radius or 100 foot diameter of the machine with only one wand in one hand and eliminates the picking up and putting down of two separate tools. This greatly reduces the opportunity for crawling insects to escape once they have emerged from their deep harborage after the flushing agent has been applied.

In many cases, the operator can actuate both the hydraulic fan spray nozzle and the air atomized aerosol simultaneously with the aerosol penetrating the void first, leaving the wet spray in, on, and around the insects entry/exit area. By using constant air to propel the aerosol, the need for costly, environmentally damaging, propellents and solvents is eliminated.

Field trials have proven that this system saves the operator approximately 25% of his service time while putting his energy to the task of eliminating the desired target pest rather than hand pumping his compressed air sprayer. This can only lead to more profits per day, more accounts serviced in a day, with an overall improvement in performance with respect to the target pest.

REFERRING NOW TO THE DRAWINGS

FIG. 4 is a cross-section of the handle along line III—III.

Figure 1:
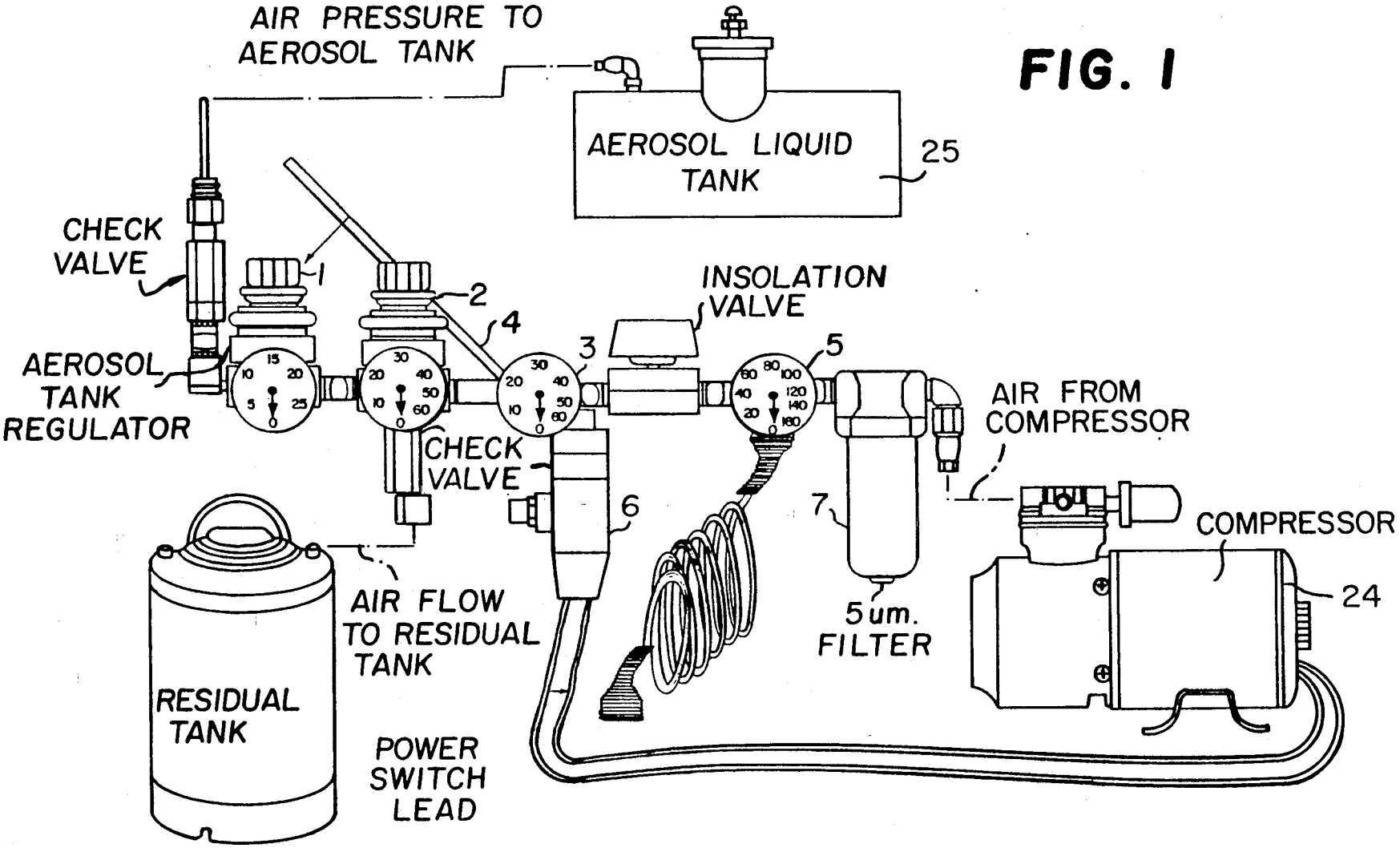
FIG. 1 illustrates the manifold system for connection of the wand assembly to the dual liquid reservoirs.

In FIG. 1, there are provided a pressure regulator 1 for the aerosol fluid tank 25, a pressure regulator 2 for the residual liquid spray, a free flowing air gauge 3 connected by flexible tube 4 to the spray handle. An optional feature is an air gauge 5 connected to an air handle 6 and a filter 7. The manifold is connected as shown in FIG. 1 to a compressor to supply air under pressure to the two liquid reservoirs and to the wand.

Figure 2:
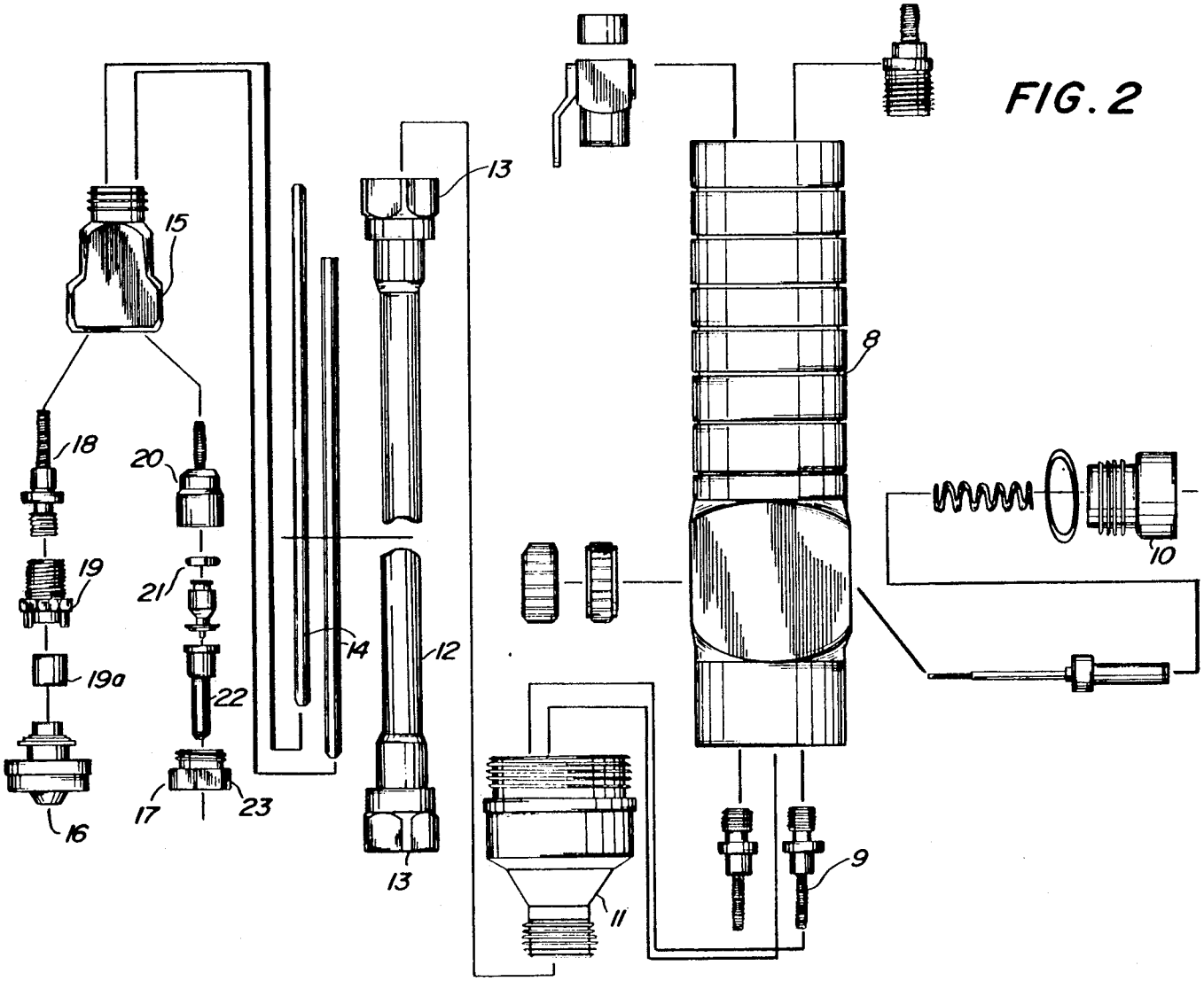
FIG. 2 is an exploded view of the wand portion of the spray system.
Figure 3:
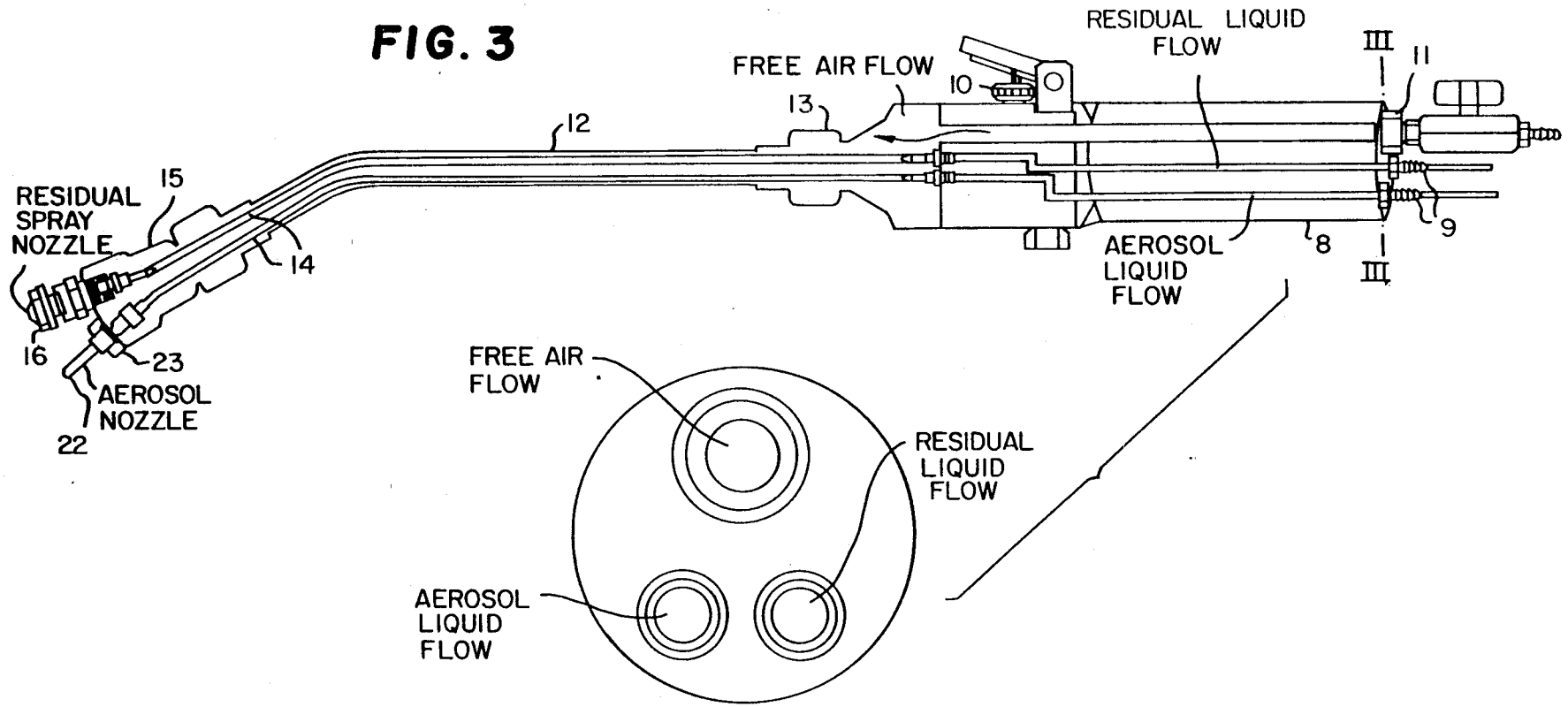
FIG. 3 is a cross-sectional view of the wand.

Referring to FIG. 2, the wand portion of the system is preferably comprised of a round, knurled, machined, hand held valve body 8 ported length-wise with three deep drilled ports each fitted at the entrance opening with female pipe threads 9, two of the ports open into the lower half of the valve chamber approximately ¾ of the length of the valve body, (these educt liquid insecticides) and the third port transverses the entire length of the machined valve body. This port educts air only under pressure which flows freely throughout the entire length of the wand and is educted to atmosphere at the air atomizing nozzle end.

The two valve ports are drilled and threaded vertically from the underside of the valve body and are set side by side and facilitate a spring loaded, thumb actuated, on/off valve assembly 10. This is preferred from a practical application perspective as the thumb is the most powerful appendage of the hand, therefore, allowing for less operator fatigue and for the simultaneous actuation of both valves. Also, the valve assembly is fitted with a valve locking mechanism for safety when not in use.

From the valve assembly, the two liquids are educted through lengh-wise ports to the forward end of the valve body 8 and connect with threaded ends and terminate. The forward end of the valve body is threaded with female threads and inset to allow for hose barbs to be threaded into the two liquid line ports where they terminate and do not extend past the female threaded end of the valve body.

Attached to the female threads at the forward most part of the valve body is a male threaded conical shaped, hollow, adapter 11 approximately 1½" in overall length with an overall outside diameter equal to the valve body and fitted with two flat surfaces on the outside diameter for tightening. The conical shape allows for downsizing and attaching via male threads to a 18" overall length ⅜" outside diameter hollow tubing 12 fitted with a female swivel nut 13 fitted with flats and ferrule attachment device soldered over each end of the ⅜" tubing.

Attached to the hose barbs on the forward most end of the valve body and transversing throughout the interior length-wise of the ⅜" hollow tubing are two flexible tubes 14 of approximately ⅛" outside diameter, one of which is of a 90 durometer to resist collapsing. This is preferred due to the action of the free flowing air under pressure and its tendency to collapse the hydraulic line forcing a leak at the nozzle end since there is no shut-off at the nozzle, while the other of 60 durometer feeds the air atomization nozzle. Note air back pressure caused by restriction at fluid cap to keep liquid in check in 60 durometer line.

Air under pressure passes freely through the interior of the ⅜" tubing 12 and over and around the flexible tubing 14 to feed solely the air atomization nozzle 21. The fluid cap then vents to atmosphere.

Attached at the nozzle end of the extension tube is a male threaded nozzle body adapter 15 of approximately 1½" overall length with a length-wise taper of approximately ½" at the extension end to 1½" at the nozzle end. The sides are machined down to eliminate any unnecessary weight and to allow for as small as possible profile. Ported and threaded into the nozzle end are two ports which are set at opposing angles set to intersect at approximately half the length of the nozzle body adaptor 15 and joining with a larger inside diameter port which in turn intersects with the ⅜" diameter extension. This allows for the two flexible tubes to pass through and be separated to feed each nozzle respectively.

The two nozzle ports 16 and 17 are positioned vertically in a piggyback fashion with the hydraulic, flow through, fan pattern nozzle assembly 16 to be set on top and continuing in the angle determined by the female threaded port. This is preferred from a practical application perspective as this requires less of a precise application as a general rule and if both nozzles are actuated at once, the wet spray is released just after the air atomized aerosol driven by air under pressure and constantly venting to atmosphere to allow for the flushing action of the aerosol to act first to penetrate deep into harborages and not to blow the wet spray out of a crack or crevice after application so that it may come in direct contact with insects on their way out and/or remain in place as a residual barrier against future entry of insects. The air atomization nozzle 17 assembly is positioned on the bottom directly under the hydraulic nozzle and continuing in the same angle as its port. This is preferred from a practical application perspective as it is the tendency to place the air atomization tip in a crack or crevice and draw the wand toward the operator allowing for sighting and placement of the nozzle from the side by slightly tilting the wand to one side or the other.

The hydraulic nozzle assembly consists of four parts, namely, a male threaded on one end hose barb 18 for connecting to the flexible capilliary liquid line via the barb and connecting to the female inside threaded portion of the hollow nozzle body 19, a male threaded on the outside machined hollow nozzle body that threads into the top port of the nozzle adapter body, an "O" ring gasket **19*a*** set in machined socket of the nozzle body which allows for a leakproof seal when the quick release portion comprising the actual nozzle is pushed in twisted 90° to lock into place. The nozzle body will accept a variety of nozzles of varying patterns such as pin stream or flat fans of varying flow rates and patterns. It should be noted that the flat fan patterns have an elliptical shape so that the patterns density be consistent at the edges as in the center. It should also be noted that the quick release nozzle facilitates the easy changing of the tips as well the cleaning of the nozzle should a stoppage occur without using tools or depressurizing the chemical container.

The air atomization nozzle assembly consists of an exit hose shank with a hose barb on one end and face seal cup 23 machined and inset to accept a rubber "O" ring seal 21, the exit hose shank 20 has a machined outside diameter with recessed shoulders allowing for the shank to extend into the nozzle body adapter 15 in such a way to allow the hose barb portion to connect with the flexible capilliary tubing while the face cup seal area rests on a shoulder machined into the nozzle body adapter deep enough for the "O" ring seal to be pressed into place to form a liquid/air tight seal while allowing air to pass around the outside of the entire hose shank. The "O" ring seal is attached onto and around the outside diameter of the arear stem rea of the fluid cap which possess a taper with holes that are laid out in a circular pattern around the collar to allow for the free flowing air to pass through. The hollow center of the fluid cap is like-wise tapered internally to a specific size to allow for liquid flow to be controlled. The fluid cap interfaces with the air cap 22 which possesses a hollow interior and a slightly larger outside diameter as the collar on the fluid cap allowing for the collar to fit flush and just inside of the air cap coming to rest on a machined in shoulder. This allows the air under pressure to pass through the collar of the fluid cap and into the flange on the air cap.

The air cap is held in place by a hex nut 23 machined at one end to allow for the air cap's extended hollow tube to pass through while the other end possesses a male outside thread which attaches to the female threads on the nozzle body adapter, the tightening of the hex nut compresses in unison the air cap, fluid cap and "O" ring to effect the air/liquid tight seal. The air under pressure is then forced down toward a tapered chamber and upon actuation of the valve encounters the liquid stream which is shattered into small droplets by the force of the air under pressure creating aerosol particles. The aerosol particles are then carried out of the air cap via the free flowing air stream into the insect's harborage. If desired, the operator may release the liquid flushing agent valve and allow the free flowing air to continue to pressurize the void without dispensing additional flushing agent. This saves pesticides and reduces environmental contamination since air is the propellant.

The system has the advantage that two products can be dispensed from a single wand without cross contamination of the product and provides constant pressure on both the aerosol side as well as the residual liquid side of the system by regulating the air, not the fluids thus greatly extending the life expectancy of the regulators.

Preferably, the three tubes are color coded so that there is no error in making the connections. An elliptical pattern to the flat fan tips applies the band in a consistent pattern at the edges as well as in the center thereby reducing runoff, staining and product waste. The quick change tips permit the cleaning and changing of tips without depressuring.

In a preferred embodiment of the invention, the liquid reservoirs and the compressor and the manifold are all mounted on a two wheel cart so that the operator could wheel the entire system to a work area and if there is a 50 foot length of the three tubes connecting the wand and the various reservoirs on the two wheel cart, the operator is free to move around within a large area so as not to have to stop to move his apparatus as he moves along. It is also possible to adapt the wand to provide for an additional line for dispensing an additional liquid or a powder spray if desired.

The switch means is adapted so that either one or both of the liquids may be applied together or both shut off. Preferably, the nozzle means are quick release nozzles so that they can be easily and quickly replaced if necessary or removed for cleaning. The metal handle of the wand is also preferably produced of metal to avoid cracking or breaking if dropped. Moreover, the metal should be resistant to the liquids passing therethrough and is preferably made out of aluminum. The use of plastic should be avoided since plastic often swells or decomposes as a result of the liquids used.

Various modifications of the invention may be made without departing from the spirit or scope thereof and it should be understood that the invention is intended to be limited only as defined in the appended claims.

What I claim is:

1. An apparatus for dispensing at least a first and a second liquid composition, one as a wet spray and one as an aersol spray comprising at least two liquid reservoirs, means for pressurizing said reservoirs, individual capillary tubes connecting said reservoirs and a pressurized air source to a dispensing wand, said wand comprising a solid handle having first and second ends and having two liquid ducts and an air duct therein, said handle first end having individual means for connecting one end of said ducts to one of the individual capillary tubes, the two liquid ducts being provided at the other end with a suitable means for controlling fluid flow therethrough, a hollow tube having first and second ends, the first end of the tube being attached at the second end of the handle, the tube having two capillary tubes therein, the two capillary tubes being attached at one end to the two liquid ducts passing through the handle and being attached at the other end to a nozzle head, the nozzle head being attached to the second end of the tube and being provided with a first nozzle means to dispense the first liquid composition as the wet spray and a second nozzle means to dispense the second liquid composition as the aersol spray, and wherein pressurized air passes through the handle directly into the hollow tube and mixes with the second liquid composition in the second nozzle means to provide the aersol spray.

2. The apparatus of claim 1 wherein the first nozzle means is located above the second nozzle means on the nozzle head.

3. The apparatus of claim 1 wherein the three capillary tubes connecting the wand to the two reservoirs and the pressurized air source are color coded and encased in a plastic sheath.

4. The apparatus of claim 1 wherein the handle is made of an aluminum, knurled, round body,

5. A wand for dispensing a first liquid as a wet spray and a second liquid as an aersol spray comprising a solid handle having a first end and a second end and having two liquid ducts and an air duct therein, said handle first end having individual means for connecting one end of each of said ducts to one of three individual capillary tubes, the two liquid ducts being provided at the other end with a suitable means for controlling fluid flow therethrough, a hollow tube having first and second ends and having two capillary tubes therein, the first end of the tube being attached to the second end of the handle and the second end of the tube being attached to a nozzle head, the two capillary tubes being attached at one end to the two liquid ducts passing through the handle and at the other end to the nozzle head, the nozzle head being provided with a first nozzle means to dispense the first liquid as the wet spray and a second nozzle means to dispense the second liquid as the aersol spray, and wherein pressurized air passes through the handle directly into the hollow tube and mixes with the second liquid in the second nozzle means to provide the aersol spray.

* * * * *